US010327075B2

(12) United States Patent
Fujitani et al.

(10) Patent No.: US 10,327,075 B2
(45) Date of Patent: Jun. 18, 2019

(54) METHOD FOR MANUFACTURING A SPEAKER DIAPHRAGM

(71) Applicant: Onkyo Corporation, Osaka (JP)

(72) Inventors: Takeshi Fujitani, Osaka (JP); Nanayo Suzuki, Niigata (JP); Shinjiro Kato, Niigata (JP); Tomoyuki Suzuki, Niigata (JP)

(73) Assignee: Onkyo Corporation, Osaka (JP)

( * ) Notice: Subject to any disclaimer, the term of this patent is extended or adjusted under 35 U.S.C. 154(b) by 104 days.

(21) Appl. No.: 15/370,083

(22) Filed: Dec. 6, 2016

(65) Prior Publication Data

US 2017/0180865 A1 Jun. 22, 2017

(30) Foreign Application Priority Data

Dec. 17, 2015 (JP) ..... 2015-245829

(51) Int. Cl.
*H01R 31/00* (2006.01)
*H04R 7/22* (2006.01)
(Continued)

(52) U.S. Cl.
CPC ..... *H04R 7/22* (2013.01); *H04R 7/127* (2013.01); *H04R 9/06* (2013.01); *H04R 31/003* (2013.01);
(Continued)

(58) Field of Classification Search
CPC . H04R 7/127; H04R 7/22; H04R 9/06; H04R 31/003; H04R 2207/021; H04R 2307/027
See application file for complete search history.

(56) References Cited

U.S. PATENT DOCUMENTS 4,291,781 A * 9/1981 Niguchi ..... D06M 17/06 162/104
5,283,027 A * 2/1994 Sakamoto ..... B29C 51/002 264/320
(Continued)

FOREIGN PATENT DOCUMENTS

EP 1480490 A1 11/2004
EP 1638365 A1 3/2006
(Continued)

OTHER PUBLICATIONS

Extended European Search Report for corresponding EP Application No. 16203691.7 dated May 16, 2017.

*Primary Examiner* — Paul D Kim
(74) *Attorney, Agent, or Firm* — Renner Otto Boisselle & Sklar, LLP

(57) ABSTRACT

A method is provided for manufacturing a speaker diaphragm manufactured using a sheet material made of magnesium or magnesium alloy and including an annular cone portion along an outer peripheral edge of a dome portion. The method includes a dome preformation process of forming a dome preformation portion; a cone preformation process of forming an annular cone preformation portion; and a shaping process of shaping the dome preformation portion into the dome portion by pressing, shaping the cone preformation portion into the cone portion whose outer peripheral end at least extends to a substantially identical height position to a maximum protrusion position of the dome portion, and forming, along a boundary portion between the dome portion and the cone portion, an annular step portion to which a voice coil bobbin is attached.

3 Claims, 9 Drawing Sheets

(51) Int. Cl.
*H04R 7/12* (2006.01)
*H04R 9/06* (2006.01)
*H04R 31/00* (2006.01)

(52) U.S. Cl.
CPC .. *H04R 2207/021* (2013.01); *H04R 2307/027* (2013.01)

(56) References Cited

U.S. PATENT DOCUMENTS 7,308,750 B2 * 12/2007 Tomiyama ..... B21B 3/00 156/250
7,567,684 B2 * 7/2009 Ono ..... H04R 9/045 381/407
7,687,001 B2 * 3/2010 Sato ..... H04R 31/003 264/259
8,002,079 B2 * 8/2011 Funahashi ..... H04R 31/003 181/169
8,045,746 B2 * 10/2011 Takayama ..... H04R 9/045 381/396
8,389,672 B2 * 3/2013 Taniguchi ..... C08J 5/18 428/220
2003/0188919 A1 * 10/2003 Suzuki ..... H04R 7/20 181/171
2004/0231136 A1 11/2004 Tomiyama et al.
2005/0257999 A1 * 11/2005 Tomiyama ..... H04R 31/003 181/168
2005/0273997 A1 * 12/2005 Tomiyama ..... H04R 31/003 29/594
2006/0062422 A1 3/2006 Ono et al.
2008/0053745 A1 * 3/2008 Tada ..... H04R 1/24 181/165
2010/0108433 A1 * 5/2010 Takayama ..... B29C 44/1233 181/169
2015/0256938 A1 9/2015 Rousseau

FOREIGN PATENT DOCUMENTS

EP 1694092 A1 8/2006
GB 2505953 A 3/2014
JP 2003163989 A 6/2003
JP 2005-168001 A 6/2005
JP 2006-93804 A 4/2006
JP 4152804 B 7/2008
JP 2014-7656 A 1/2014

* cited by examiner

METHOD FOR MANUFACTURING A SPEAKER DIAPHRAGM

BACKGROUND OF THE INVENTION

1. Field of the Invention

The present invention relates to a diaphragm used for a speaker, and particularly relates to a balance dome-type diaphragm including a cone portion at the periphery of a dome portion, a speaker including the diaphragm, and the method for manufacturing the speaker diaphragm.

2. Description of the Related Art

With widespread use of high-resolution audio, a speaker being able to reduce disturbance of sound pressure frequency properties of a high-tone range including an extremely high-tone range of equal to or higher than 20 kHz has been recently developed. Generally, a metal-based diaphragm exhibits a higher stiffness and a higher high-tone range threshold frequency as compared to a resin-based diaphragm, and therefore, is suitable for high-tone range reproduction. Of diaphragm materials, magnesium or magnesium alloy is the most suitable metal material for high-tone range reproduction because such a material has a lower specific gravity and exhibits less sound pressure reduction as compared to aluminum and titanium.

For example, Japanese Patent No. 4152804 describes a dome-type diaphragm configured such that a dome portion and an edge are integrally formed of a thin magnesium sheet, the magnesium sheet being formed in such a manner that a magnesium base material is rolled several times with different rolling amounts.

However, as the crystal structure of magnesium is a hexagonal close-packed structure, magnesium is strongly plastically anisotropic and is less likely to stretch. For these reasons, it is difficult to perform plastic working for magnesium or magnesium alloy. Thus, such a material can be processed into a simple shape as in the dome-type diaphragm described in Japanese Patent No. 4152804, but it is difficult to bend a magnesium sheet into a complicated shape such as a balance dome shape including a cone portion at the periphery of a dome portion and being suitable for output with a high-tone range. For this reason, the dome portion and the cone portion are, in a typical case, separately formed from a magnesium or magnesium alloy sheet material, and are bonded together with an adhesive. In this manner, a balance dome-type diaphragm is formed. In this case, a joint line is formed along a boundary between the dome portion and the cone portion of the diaphragm. This leads to a problem that a sound pressure level is lowered due to an adhesive weight load, and therefore, sound pressure frequency properties are disturbed. Moreover, the dome portion and the cone portion of the speaker diaphragm are bonded with the adhesive, leading to a problem that a manufacturing cost increases due to an increase in the number of working processes.

SUMMARY OF THE INVENTION

An object of the present invention is to provide a speaker diaphragm being able to reduce disturbance of sound pressure frequency properties of a high-tone range including an extremely high-tone range while reducing a manufacturing cost, a speaker including the speaker diaphragm, and the method for manufacturing the speaker diaphragm.

A speaker diaphragm of one aspect of the present invention is a speaker diaphragm vibratably supported by a speaker body through an edge. Such a speaker diaphragm includes a protruding dome portion formed at a center portion of the diaphragm, and an annular cone portion extending from an outer peripheral edge of the dome portion in the direction inclined with respect to the protrusion direction of the dome portion. The dome portion and the cone portion are, in a seamless manner, integrally formed of a sheet material made of magnesium or magnesium alloy, and an outer peripheral end of the cone portion at least extends to a substantially identical height position to the maximum protrusion position of the dome portion. An annular step portion for attachment of a cylindrical voice coil bobbin is provided along a boundary portion between the dome portion and the cone portion. The "seamless manner" described herein means that one in which the dome portion and the cone portion are bonded with an adhesive etc., for example is excluded. Moreover, the "substantially identical height position" means not only the case where the maximum protrusion position of the dome portion and the position of the outer peripheral end of the cone portion are at the same height position, but also the case where the position of the outer peripheral end of the cone portion is slightly lower than the maximum protrusion position of the dome portion.

In the speaker diaphragm of the present invention, the annular step portion may include a contact surface extending in the direction perpendicular to the protrusion direction of the dome portion to contact an end surface of the voice coil bobbin in the axial direction thereof, and a guide surface extending along a side surface of the voice coil bobbin from the contact surface in the direction opposite to the protrusion direction of the dome portion.

Moreover, in the speaker diaphragm of the present invention, the annular step portion may be formed to satisfy a relationship of $0.28a<b<2.5a$ where a represents the width of the contact surface in the direction perpendicular to the protrusion direction of the dome portion and b represents the height of the guide surface in the protrusion direction of the dome portion.

The speaker diaphragm of the present invention may include an edge configured to vibratably support the outer peripheral end of the cone portion of the speaker diaphragm, and a voice coil attached to the step portion of the speaker diaphragm.

A speaker of another aspect of the present invention includes the speaker diaphragm according to any of the above-described configurations, a frame configured to vibratably support the speaker diaphragm through the edge, and a magnetic circuit with a magnetic gap into which the voice coil is inserted.

The method for manufacturing a speaker diaphragm according to said another aspect of the present invention is the method for manufacturing a speaker diaphragm manufactured using a sheet material made of magnesium or magnesium alloy and including a cone portion along an outer peripheral edge of a dome portion. Such a method includes a dome preformation process of forming a dome preformation portion in such a manner that the sheet material made of magnesium or magnesium alloy is, by pressing, protruded several times with a predetermined protrusion height, a cone preformation process of forming an annular cone preformation portion in such a manner that a portion of the sheet material at the outer periphery of the dome preformation portion is, by pressing, bent several times with a predetermined bending amount in the direction inclined with respect to the protrusion direction of the dome preformation portion, and a shaping process of shaping the dome preformation portion into the dome portion by pressing, shaping the cone preformation portion into the cone portion whose outer peripheral end at least extends to a substantially identical height position to the maximum protrusion position of the dome portion, and forming, along a boundary portion between the dome portion and the cone portion, an annular step portion to which a voice coil bobbin is attached.

In the speaker diaphragm manufacturing method of the present invention, the predetermined protrusion height is set less than the maximum protrusion height of the dome portion of the speaker diaphragm, and the predetermined bending amount may be set less than the protrusion height of the outer peripheral end of the cone portion of the speaker diaphragm.

According to the speaker diaphragm of one aspect of the present invention, the dome portion and the cone portion of the speaker diaphragm are, in the seamless manner, integrally formed of the sheet material made of magnesium or magnesium alloy, and therefore, disturbance of the sound pressure frequency properties of the high-tone range including the extremely high-tone range can be reduced. Further, since the bonding process of bonding, with an adhesive, the dome portion and the cone portion of the speaker diaphragm is not necessary, the number of working processes can be reduced, and therefore, the manufacturing cost can be also reduced.

According to the speaker of another aspect of the present invention, the dome portion and the cone portion of the speaker diaphragm are, in the seamless manner, integrally formed of the sheet material made of magnesium or magnesium alloy, and therefore, disturbance of the sound pressure frequency properties of the high-tone range including the extremely high-tone range can be reduced. Further, since it is not necessary to bond the dome portion and the cone portion with the adhesive, the manufacturing cost can be reduced.

According to the speaker diaphragm manufacturing method of still another aspect of the present invention, after the dome preformation portion and the cone preformation portion have been formed in such a manner that the sheet material made of magnesium or magnesium alloy is protruded in a stepwise manner, the dome portion and the cone portion can be shaped. Thus, the speaker diaphragm including the dome portion and the cone portion formed along the outer peripheral edge of the dome portion can be formed while occurrence of wrinkling and breaking of the sheet material is reduced. As a result, the speaker diaphragm being able to reduce disturbance of the sound pressure frequency properties of the high-tone range including the extremely high-tone range can be manufactured.

DETAILED DESCRIPTION OF THE PREFERRED EMBODIMENTS

Hereinafter, an embodiment of the present invention will be described in detail with reference to the attached drawings. In such description, specific shapes, materials, numerical values, directions, etc. are examples for the sake of easy understanding of the present invention, and can be optionally changed according to use applications, purposes, specifications, etc. Moreover, in the case of including a plurality of embodiments and variations etc., it is initially assumed that features of these embodiments and variations etc. are optionally used in combination.

Figure 1:
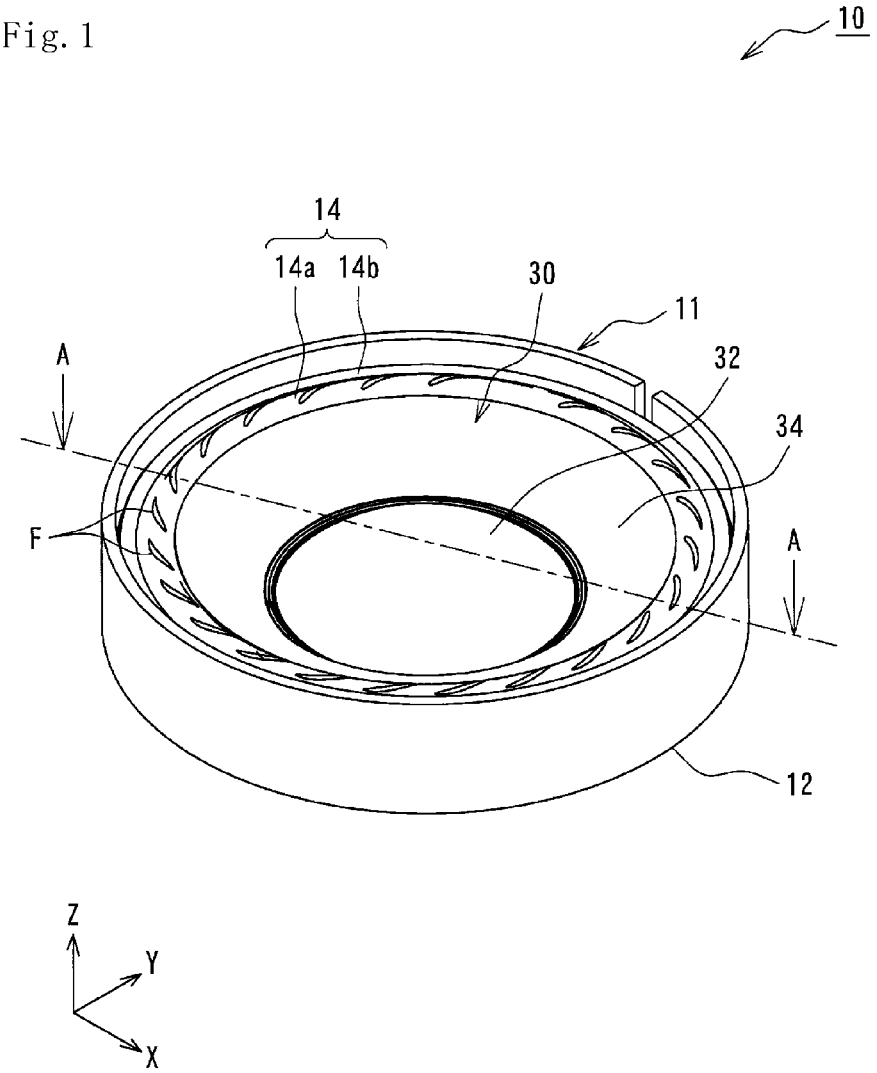
FIG. 1 is a perspective view of a speaker including a speaker diaphragm of an embodiment of the present invention.
Figure 2:
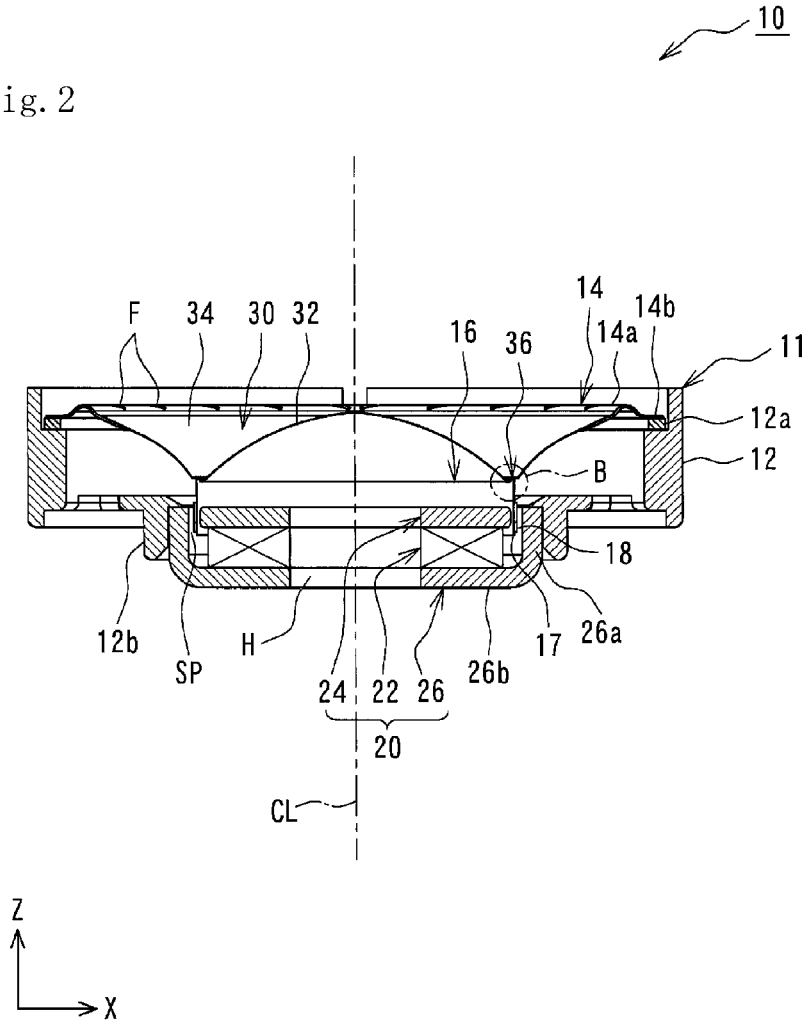
FIG. 2 is a longitudinal sectional view along an A-A line of FIG. 1.

FIG. 1 is a perspective view of a speaker 10 including a speaker diaphragm 30 of an embodiment of the present invention. FIG. 2 is a longitudinal sectional view along an A-A line of FIG. 1. In FIGS. 1 and 2, the vibration direction of the diaphragm 30 is illustrated as a Z-axis direction (a protrusion direction), and the plane perpendicular to such a vibration direction is illustrated as an X-Y plane. In FIG. 2, the shaft center of the speaker 10 is illustrated as "CL." As illustrated in FIGS. 1 and 2, the speaker 10 is, e.g., an electrodynamic speaker attached to headphones, and a substantially discoid electroacoustic transducer. The speaker 10 includes a speaker body 11 having a frame 12 defining the outer shape of the speaker 10. A frame formed by molding of a material with a proper strength into a predetermined shape can be used as the frame 12. For example, a resin molded article can be used as the frame 12. The speaker 10 further includes, in an internal space of the frame 12, vibration system components such as the diaphragm 30, an edge 14, and a voice coil 16 and a magnetic circuit 20.

First, other components than the diaphragm 30 will be described. As illustrated in FIG. 1, the edge 14 includes a roll portion 14*a* disposed along an outer peripheral end of the diaphragm 30 and curved in an arc shape, and a flange portion 14*b* continuously connected to an outer peripheral edge of the roll portion 14*a*. An inner peripheral end of the roll portion 14*a* of the edge 14 is fixed to the outer peripheral end of the diaphragm 30 with a fixing unit such as an adhesive, and vibratably supports the diaphragm 30. Moreover, at the roll portion 14*a*, grooves F are provided at equal pitches. On the other hand, the flange portion 14*b* of the edge 14 is, with a fixing unit such as an adhesive, fixed to an annular ring 12*a* attached to the frame 12. An edge molded, using thermoplastic elastomer resin, into a predetermined shape with flexibility can be used as the edge 14. The following resins can be used as the thermoplastic elastomer resin: polyurethane-based resin, polyolefin-based resin, polyamide-based resin, polyethylene-based resin, and polystyrene-based resin. Alternatively, rubber, foamed rubber, coating cloth, etc. may be used as the material of the edge 14.

As illustrated in FIG. 2, the voice coil 16 includes a voice coil bobbin 17 and coils 18 wound around the voice coil bobbin 17. The voice coil bobbin 17 is a thin insulating cylindrical member formed in a substantially circular ring shape. For example, a resin film having a proper strength and heat resistance can be used as the thin insulator. Each coil 18 is formed in such a manner that a conductive wire with an insulating coating is wound with a predetermined number of turns along a circular ring-shaped outer peripheral surface of the voice coil bobbin 17. A wire formed such that a copper wire having a circular cross section is covered with insulating varnish can be used as the conductive wire with the insulating coating. An upper end portion of the voice coil 16 in the axial direction thereof is fixed to the later-described diaphragm 30.

As illustrated in FIG. 2, the magnetic circuit 20 includes a substantially circular ring-shaped magnet 22, a top plate 24, and a yoke 26. The magnet 22 is, in a multilayer state, disposed in a cylindrical portion 12*b* provided at an end portion of the frame 12 in the axial direction thereof in the state in which upper and lower sides of the magnet 22 are sandwiched between the top plate 24 and the yoke 26 in a cylindrical shape with a closed bottom. For example, the following materials can be used as the material of the magnet 22: ferrite magnet; alnico-based magnet as alloy of aluminum, nickel, and cobalt; and rare-earth magnet containing neodymium. In the yoke 26, an outer peripheral portion 26*a* extends upward to the position facing an outer peripheral surface of the top plate 24 in the state in which the coils 18 wound around the voice coil bobbin 17 are interposed between the yoke 26 and the top plate 24, and a magnetic gap SP is formed between the top plate 24 and the yoke 26. The above-described voice coil 16 is inserted into the magnetic gap SP. The top plate 24 is formed in a substantially circular ring shape having the same inner diameter as that of the magnet 22. On the other hand, a through-hole H having the same size as the inner diameter of the substantially circular ring-shaped magnet 22 is also provided at a bottom portion 26*b* of the yoke 26. Thus, an internal space of the voice coil bobbin 17 communicates with the outside. As a result, heat dissipation can be enhanced, and bass output properties can be adjusted.

Figure 3A:
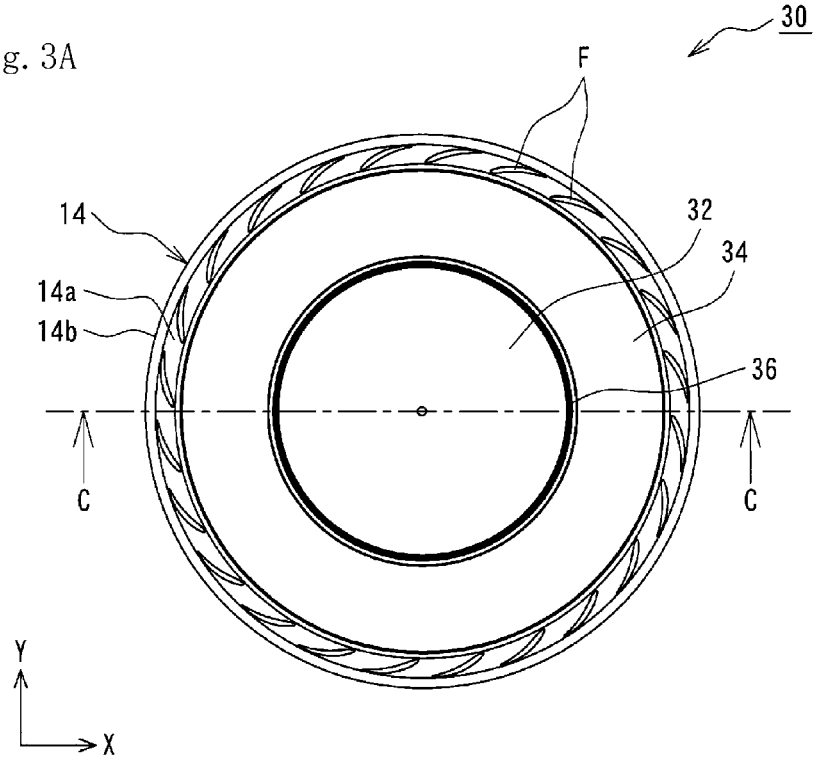
FIG. 3A is a plan view of the speaker diaphragm.

Subsequently, the configuration of the diaphragm 30 will be described with reference to FIGS. 3A and 3B. FIG. 3A is a plan view of the diaphragm 30, and FIG. 3B is a longitudinal sectional view along a C-C line of FIG. 3A.

As illustrated in FIG. 3A, the balance dome-type diaphragm 30 is a balance dome-type diaphragm including a dome portion 32 formed protruding in the Z-axis direction at a center portion of the diaphragm, and an annular cone portion 34 extending from an outer peripheral edge of the dome portion 32 in the direction inclined with respect to the Z-axis direction. Moreover, a step portion 36 is preferably provided along a boundary portion between the dome portion 32 and the cone portion 34 of the diaphragm 30. The dome portion 32 may be formed in a planar shape with a constant degree of curvature, may be defined by curved surfaces with different curvatures, or may be formed in a spindle shape. The annular cone portion 34 may be defined by a curved surface such as a truncated conical circumferential surface, or may be defined by a curved surface protruding in a raised shape in the same direction as protrusion of the dome portion 32 or a curved surface sinking in a recessed shape in an opposite direction.

Figure 3B:
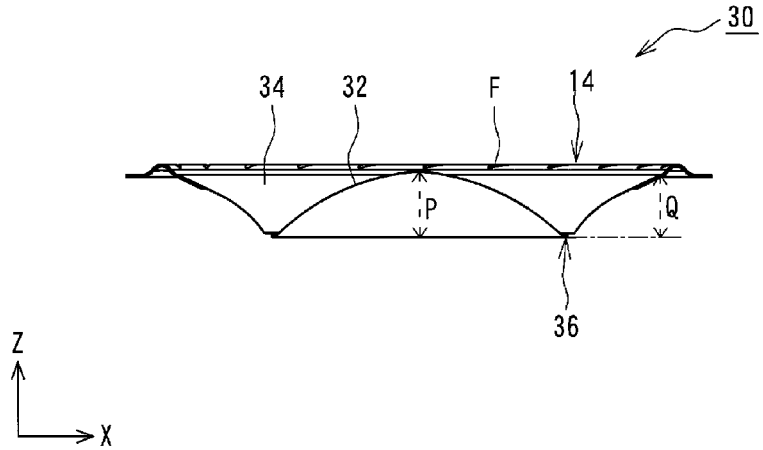
FIG. 3B is a longitudinal sectional view along a C-C line of FIG. 3A.

As illustrated in FIG. 3B, the cone portion 34 of the diaphragm 30 extends to a position at the substantially same height as that of the maximum protrusion position of the dome portion 32 of the diaphragm 30. Thus, the height P of the maximum protrusion position of the dome portion 32 and the height Q of an outer peripheral end of the cone portion 34 are substantially the same as each other. The "substantially same height" means not only the case where the height P of the maximum protrusion position of the dome portion 32 and the height Q of the outer peripheral end of the cone portion 34 are the same as each other, but also the case where the height Q of the outer peripheral end is slightly lower than the height P of the dome portion 32. Moreover, the height Q of the outer peripheral end of the cone portion 34 of the diaphragm 30 may be higher than the height P of the maximum protrusion position of the dome portion 32.

The dome portion 32 and the cone portion 34 of the diaphragm 30 are formed in such a manner that a sheet material made of magnesium or magnesium alloy is bent by pressing as described later. Thus, the dome portion 32 and the cone portion 34 are integrally formed in a seamless manner. In the present embodiment, the "seamless manner" means that no bonding with an adhesive etc. is made, for example.

Figure 4A:
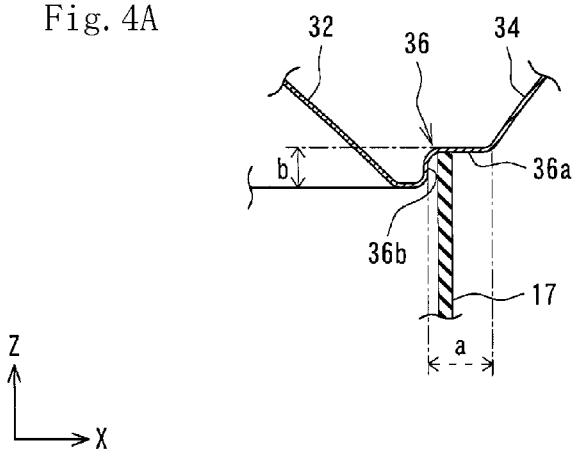
FIG. 4A is a partially-enlarged view of a region B illustrated in FIG. 2.
Figure 4B:
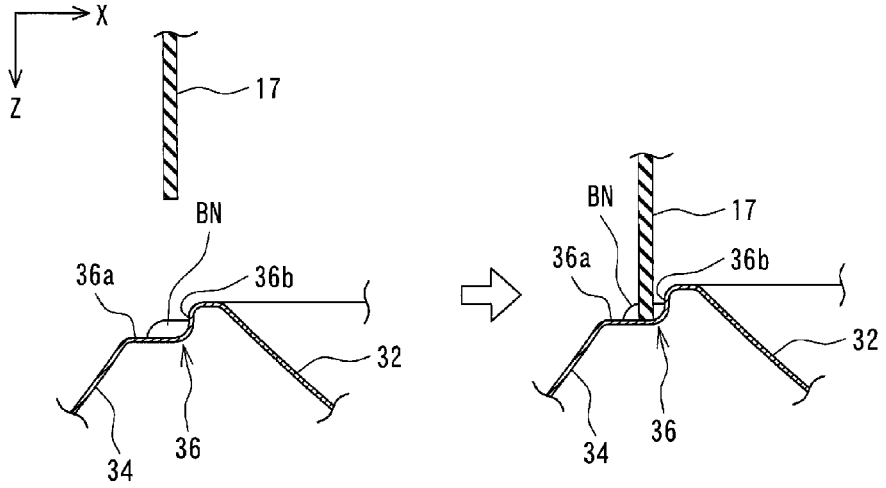
FIG. 4B is a view of a state in attachment of a voice coil bobbin to a step portion of the diaphragm.

Next, the configuration of the step portion 36 of the diaphragm 30 will be described with reference to FIGS. 4A and 4B. FIG. 4A is a partially-enlarged view of a region B illustrated in FIG. 2, and FIG. 4B is a view of a state in attachment of the voice coil bobbin 17 to the step portion 36 of the diaphragm 30. As illustrated in FIG. 4A, the step portion 36 of the diaphragm 30 includes a contact surface 36*a* substantially parallel to the X-Y plane, and a guide surface 36*b* substantially parallel to the Z-axis direction. The contact surface 36*a* of the step portion 36 is a surface to which an upper end surface of the voice coil bobbin 17 in the axial direction thereof is fixed in contact with the surface. The guide surface 36*b* is provided on an inner diameter side with respect to the contact surface 36*a* to closely face an inner peripheral surface of the voice coil bobbin 17.

As illustrated in FIG. 4B, in attachment of the voice coil bobbin 17 to the diaphragm 30, an adhesive BN such as epoxy resin is applied to the step portion 36 of the diaphragm 30 in the state in which the diaphragm 30 is placed on a lower side, and then, an upper end of the voice coil bobbin 17 is bonded and fixed in contact with the contact surface 36*a* while being along the guide surface 36*b* of the step portion 36. Since the upper end of the voice coil bobbin 17 contacts the contact surface 36*a* as described above, displacement of a bonding position of the voice coil bobbin 17 can be prevented. Thus, variation in sound pressure frequency properties of the diaphragm 30 due to displacement of the bonding position of the voice coil bobbin 17 can be prevented. Moreover, since the step portion 36 is provided at the diaphragm 30, the adhesive BN can be easily applied, and workability in a bonding process can be improved.

As illustrated in FIG. 4A, setting is preferably made such that a relationship indicated by the following expression (1) is satisfied:

$$0.28a<b<2.5a \quad (1)$$

where the width of the contact surface 36*a* in an X-direction is "a," and the width of the guide surface 36*b* in the Z-direction is "b."

In the present embodiment, a is 0.25 mm, and b is 0.25 mm, for example. Moreover, a diaphragm of a first comparative example is formed such that the width a of the contact surface 36*a* of the step portion 36 of the diaphragm 30 is 1 mm, that the height b of the guide surface 36*b* is 0.28 mm (b=0.28a), and that other configurations are the same as those of the diaphragm 30. Similarly, a diaphragm of a second comparative example is configured such that the width a of the contact surface is 0.25 mm and that the height b of the guide surface is 0.625 mm (b=2.5a).

Figure 5:
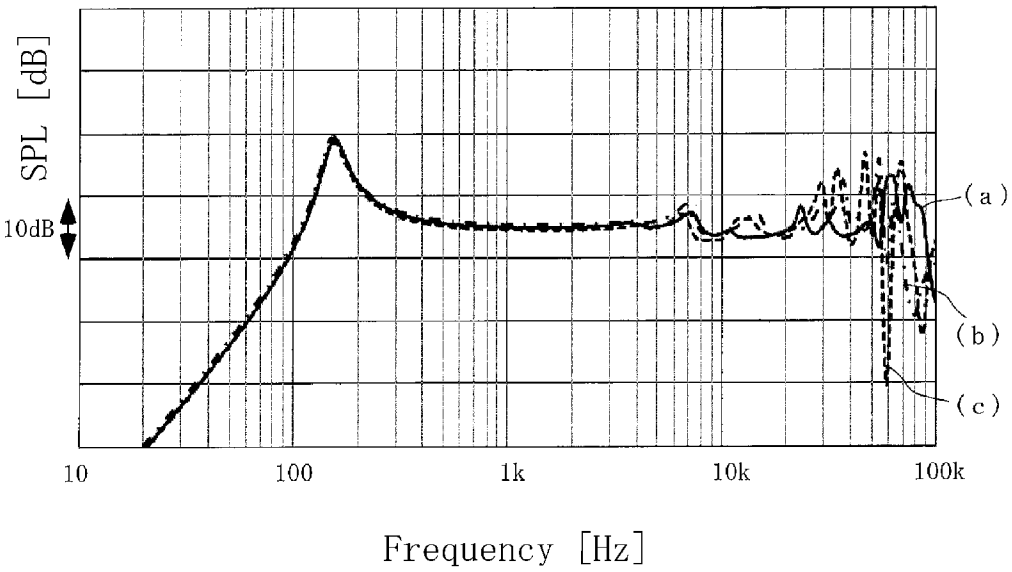
FIG. 5 is a graph showing sound pressure frequency properties obtained by a finite element method for (a) the diaphragm of the embodiment of the present invention, (b) a diaphragm of a first comparative example, and (c) a diaphragm of a second comparative example.

FIG. 5 is a graph showing results of simulation of sound pressure frequency properties by a finite element method for (a) the diaphragm 30 of the present embodiment, (b) the diaphragm of the first comparative example, and (c) the diaphragm of the second comparative example.

As shown in FIG. 5, it can be seen that the diaphragm 30 of the present embodiment shows less peaks and dips as compared to the diaphragms of the first and second comparative examples even in a high-tone range of equal to or higher than 10 kHz and disturbance of the sound pressure frequency properties is reduced. On the other hand, in the diaphragm of the first comparative example, the width a of the contact surface 36*a* of the step portion 36 is longer than the guide surface 36*b* of the step portion 36, and therefore, the adhesive BN thinly expands on the contact surface 36*a*. For this reason, bonding between the voice coil bobbin 17 and the step portion 36 is weak, and peaks and dips are easily caused in a high-tone range due to insufficient bonding strength between the voice coil bobbin 17 and the step portion 36. In the diaphragm of the second comparative example, the height b of the guide surface 36*b* of the step portion 36 is extremely longer than the width a of the contact surface 36*a* of the step portion 36, and therefore, bonding strength between the guide surface 36*b* and the voice coil bobbin 17 is extremely high. For this reason, disturbance of vibration of the diaphragm is easily caused in the high-tone range, and peaks and dips become greater. This leads to greater disturbance of the sound pressure frequency properties. On the other hand, according to the diaphragm 30 of the present embodiment, the adhesive BN with a sufficient thickness can adhere to the contact surface 36*a*, and sufficient bonding strength can be obtained by solidification of the adhesive BN into which the upper end of the voice coil bobbin 17 is inserted. Moreover, since the length of the guide surface 36*b* is proper, the bonding strength with the voice coil bobbin 17 does not become extremely high, and disturbance of the sound pressure frequency properties in the high-tone range can be also reduced.

Figure 6A:
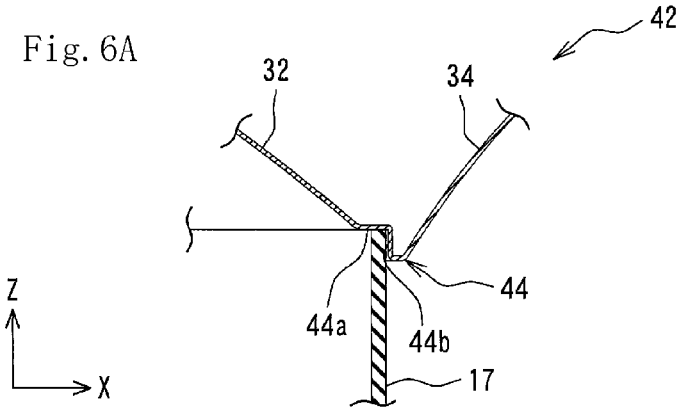
FIG. 6A is a view of a diaphragm of a first variation.

Subsequently, first and second variations of the step portion 36 of the diaphragm 30 will be described with reference to FIGS. 6A and 6B. FIG. 6A is a partially-enlarged view of a step portion 44 of a diaphragm 42 as the first variation, and FIG. 6B is a partially-enlarged view of a step portion 46 of a diaphragm 45 as the second variation.

The diaphragms 42, 45 are different from the diaphragm 30 only in the configurations of the step portions 44, 46, and therefore, only the configurations of the step portions 44, 46 of the diaphragms 42, 45 will be described below.

As illustrated in FIG. 6A, the step portion 44 of the diaphragm 42 includes a contact surface 44*a* contacting the upper end surface of the voice coil bobbin 17, and a guide surface 44*b* provided on an outer side with respect to the contact surface 44*a*. The contact surface 44*a* is formed substantially parallel to the X-Y plane. The guide surface 44*b* is formed substantially parallel to the Z-axis direction, and is disposed to closely face the outer peripheral surface of the voice coil bobbin 17.

Figure 6B:
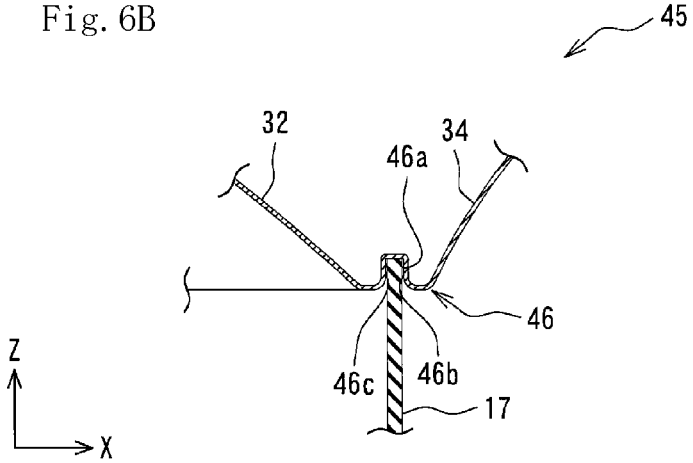
FIG. 6B is a view of a diaphragm of a second variation.

As illustrated in FIG. 6B, the step portion 46 of the diaphragm 45 includes a contact surface 46*a* contacting the upper end surface of the voice coil bobbin 17 and being substantially parallel to the X-Y plane, and guide surfaces 46*b*, 46*c* continuously extending substantially perpendicular to the contact surface 46*a* from both ends of the contact surface 46*a*. According to this configuration, the upper end of the voice coil bobbin 17 is sandwiched between two guide surfaces 46*b*, 46*c*, and therefore, the voice coil bobbin 17 is more difficult to displace from the bonding position.

Figure 7:
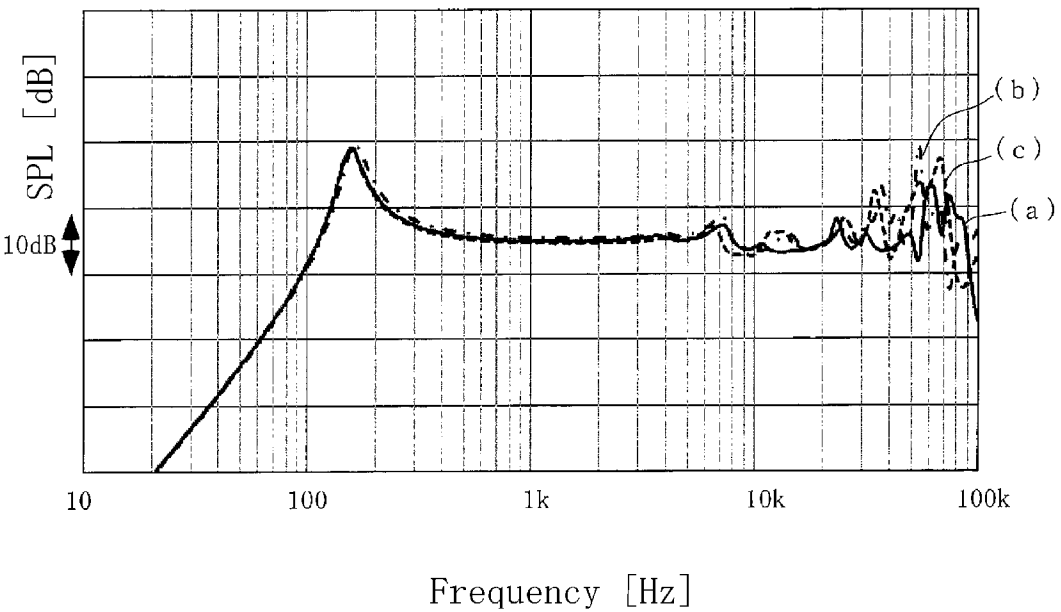
FIG. 7 is a graph showing the sound pressure frequency properties obtained by the finite element method for (a) the diaphragm of the embodiment of the present invention, (b) the diaphragm of the first variation, and (c) the diaphragm of the second variation.

FIG. 7 is a graph showing results of simulation of the sound pressure frequency properties by the finite element method for (a) the diaphragm 30 of the above-described embodiment, (b) the diaphragm 42 of the first variation, and (c) the diaphragm 45 of the second variation.

As shown in FIG. 7, it can be seen, as in the diaphragm 30 of the above-described embodiment, that the diaphragms 42, 45 show less peaks and dips even in a high-tone range of equal to or higher than 10 kHz and disturbance of the sound pressure frequency properties is reduced.

According to the speaker 10 of the above-described embodiment, the dome portion 32 and the cone portion 34 of the speaker diaphragm 30 are, in the seamless manner, integrally formed of the sheet material made of magnesium or magnesium alloy, and therefore, disturbance of the sound pressure frequency properties in the high-tone range including an extremely high-tone range of equal to or higher than 20 kHz can be reduced. Moreover, even in the case of the balance dome-type speaker diaphragm, the dome portion 32 and the cone portion 34 are not necessarily bonded together with an adhesive, and therefore, a manufacturing cost can be reduced without the trouble of bonding the dome portion 32 and the cone portion 34 together.

Figure 8:
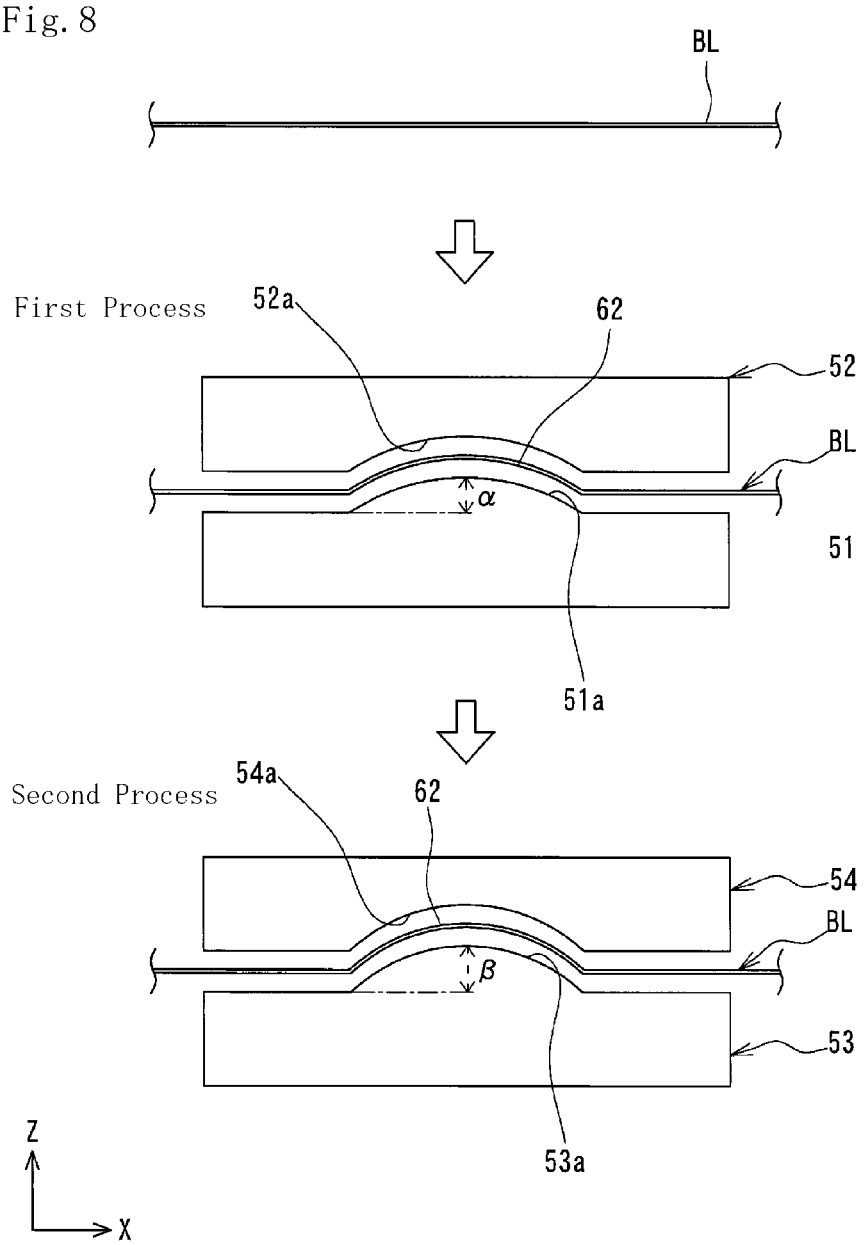
FIG. 8 is a view of first and second processes in the method for manufacturing the speaker diaphragm of the embodiment of the present invention.
Figure 9:
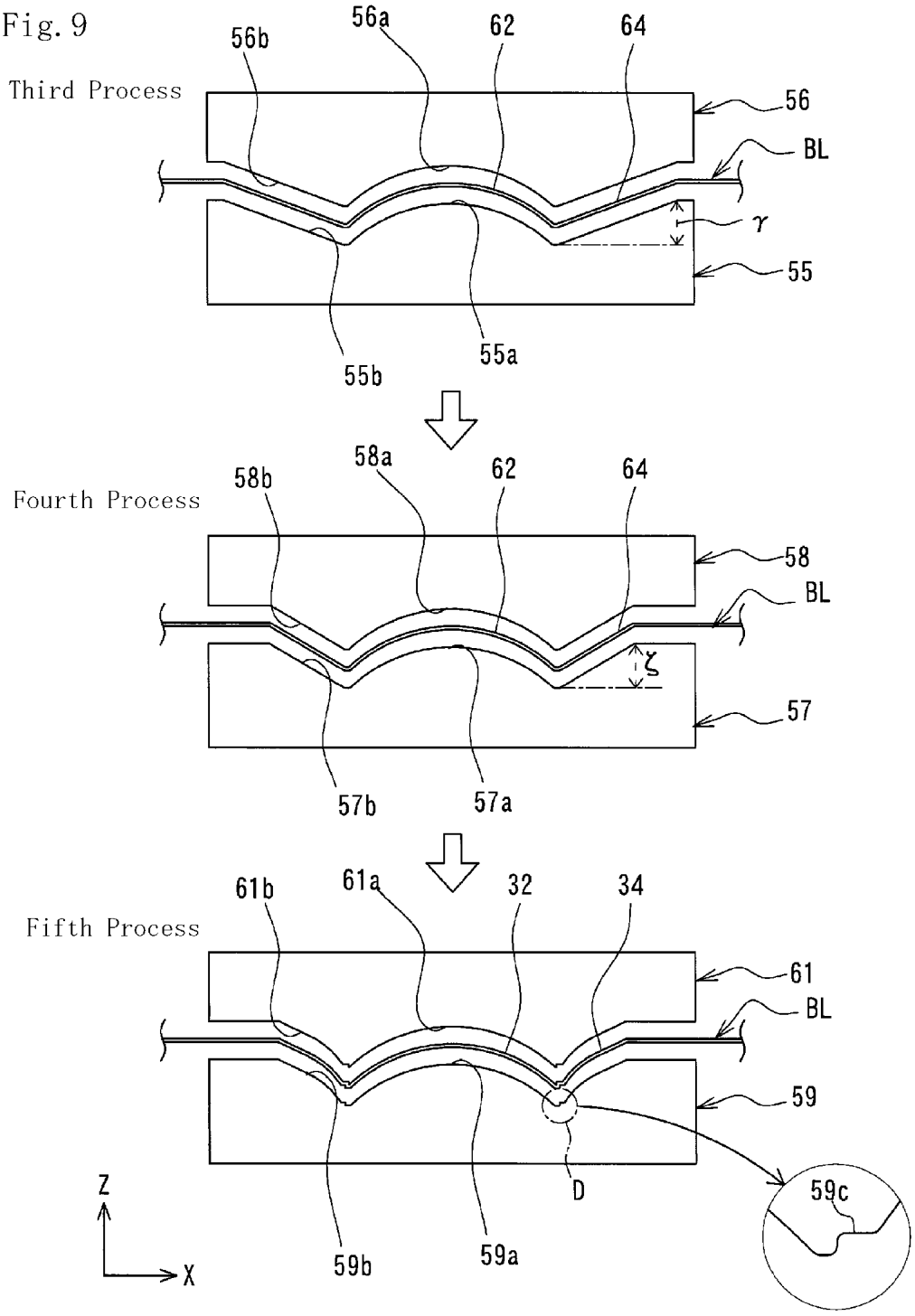
FIG. 9 is a view of third to fifth processes in the speaker diaphragm manufacturing method as in FIG. 8.

Subsequently, the method for manufacturing the above-described diaphragm 30 will be described with reference to FIGS. 8 and 9. The crystal structure of magnesium metal is a hexagonal close-packed structure. Thus, magnesium metal is less likely to stretch due to a stronger plastic anisotropy than that of other metals such as aluminum, and it is difficult to perform plastic working for magnesium metal. For these reasons, it is extremely difficult to form the balance dome-type speaker diaphragm configured such that the dome portion and the cone portion are, in the seamless manner, integrally formed of the sheet material made of magnesium or magnesium alloy and that the outer peripheral end of the cone portion at least extends to the substantially same height position as that of the maximum protrusion position of the dome portion. Note that such a diaphragm can be realized by the following manufacturing method. FIG. 8 is a view of first and second processes in the method for manufacturing the diaphragm 30 according to the above-described embodiment. FIG. 9 is a view of third to fifth processes subsequent to the processes of FIG. 8 in the method for manufacturing the diaphragm 30. In FIGS. 8 and 9, a cross-sectional shape passing through the shaft center CL of a sheet material BL sandwiched between first and second molds is illustrated for each process.

As illustrated in FIG. 8, a sheet material BL made of magnesium or magnesium alloy is first prepared. The thickness of the sheet material BL is 45 μm in the above-described embodiment, but may be equal to or less than 1 mm. Moreover, e.g., magnesium alloy AZ31 may be used as the sheet material BL.

In the first process (a dome preformation process), the sheet material BL is, as illustrated in FIG. 8, sandwiched between a first mold 51 having, at a center portion thereof, a protrusion 51*a* protruding in a dome shape or a conical shape and a second mold 52 having a recessed portion 52*a* corresponding to the protrusion 51*a*. Then, a center portion of the sheet material BL is protruded with a predetermined protrusion height a in the Z-axis direction, thereby forming a dome preformation portion 62. At this point, the first mold 51 and the second mold 52 are preheated to 200° C. to 240° C. This allows the sheet material BL to easily plastically deform. At the following processes, each mold is similarly heated.

The protrusion height a of the sheet material BL by the first mold 51 and the second mold 52 in the first process may be set to satisfy the following expressions (2) to (4) with respect to the height P (see FIG. 3B) of the maximum protrusion position of the dome portion 32 of the diaphragm 30. In the following expressions, "t" represents the thickness of the sheet material BL.

$$0.4P \leq \alpha < P (100\ \mu m \leq t \leq 1\ mm) \quad (2)$$

$$0.5P \leq \alpha \leq 0.95P (50\ \mu m \leq t < 100\ \mu m) \quad (3)$$

$$0.6P \leq \alpha \leq 0.9P (t < 50\ \mu m) \quad (4)$$

The protrusion height a is set according to the above-described expressions (2) to (4) so that the sheet material BL can gradually plastically deform. Thus, occurrence of wrinkling and breaking of the sheet material BL can be reduced.

As in the first process, the sheet material BL is, in the second process (the dome preformation process), sandwiched between a first mold 53 having a protrusion 53*a* and a second mold 54 having a recessed portion 54*a* corresponding to the protrusion 53*a*, and the dome preformation portion 62 of the sheet material BL is protruded with a predetermined protrusion height β in the Z-axis direction. The protrusion height β may be set according to the above-described expressions (2) to (4) as in the protrusion height a in the above-described first process. Alternatively, the protrusion height β in the second process may be set greater than the protrusion height a in the first process. In this manner, the dome preformation portion 62 can be processed in a more stepwise manner, and therefore, wrinkling and breaking of the sheet material BL are less likely to be caused.

The number of pressing in the second process is not limited to one, and pressing may be performed several times. In the case of performing pressing several times in the second process, the protrusion height β may be changed every time pressing is performed. Note that the protrusion height β may be the same as the protrusion height α in the first process.

In the third process (a cone preformation process), the sheet material BL is, as illustrated in FIG. 9, sandwiched between a first mold 55 having a dome-shaped protrusion 55*a* and a substantially circular ring-shaped cone shaping portion 55*b* along an outer peripheral edge of the protrusion 55*a* and a second mold 56 having a recessed portion 56*a* corresponding to the protrusion 55*a* and a cone shaping portion 56*b* corresponding to the cone shaping portion 55*b*. The protrusion 55*a* of the first mold 55 may have the same shape as that of the protrusion 53*a* of the first mold 53 in the second process. In this manner, a portion of the sheet material BL at the outer periphery of the dome preformation portion 62 is, with a predetermined bending amount γ, bent in the same direction as the protrusion direction of the dome preformation portion 62, thereby forming a cone preformation portion 64. As in the protrusion height a in the first process, the predetermined bending amount γ may be set to satisfy the following expressions (5) to (7) with respect to the height Q (see FIG. 3B) of the outer peripheral end of the cone portion 34 of the diaphragm 30.

$$0.4Q \leq \gamma < Q (100\ \mu m \leq t \leq 1\ mm) \quad (5)$$

$$0.5Q \leq \gamma \leq 0.95Q (50\ \mu m \leq t < 100\ \mu m) \quad (6)$$

$$0.6Q \leq \gamma \leq 0.9Q (t < 50\ \mu m) \quad (7)$$

In the fourth process (the cone preformation process), the sheet material BL is, as in the third process, sandwiched between a first mold 57 having a protrusion 57*a* and a cone shaping portion 57*b* and a second mold 58 having a recessed portion 58*a* corresponding to the protrusion 57*a* and a cone shaping portion 58*b*. In this manner, the cone preformation portion 64 of the sheet material BL is further bent in the Z-axis direction with a predetermined bending amount ζ. The predetermined bending amount ζ may be set as in the predetermined bending amount γ in the third process. In this manner, the cone preformation portion 64 of the sheet material BL can be bent and processed in a stepwise manner. As in the above-described second process, the predetermined bending amount ζ in the fourth process may be set greater than the predetermined bending amount γ in the third process. Further, the number of pressing in the fourth process is not limited to one, and the cone preformation portion 64 of the sheet material BL may be bent in such a manner that pressing is performed several times.

In the fifth process (a shaping process), pressing is performed in the state in which the sheet material BL is, as illustrated in FIG. 9, sandwiched between a first mold 59 having a protrusion 59*a* with the substantially same cross-sectional shape as that of the dome portion 32 of the diaphragm 30 and a cone shaping portion 59*b* having the substantially same cross-sectional shape as that of the cone portion 34 and a second mold 61 having a recessed portion 61*a* corresponding to the protrusion 59*a* and a cone shaping portion 61*b* corresponding to the cone shaping portion 59*b*. Moreover, a step shaping portion 59*c* having the same cross-sectional shape as that of the annular step portion 36 of the diaphragm 30 may be provided at a boundary portion between the protrusion 59*a* and the cone shaping portion 59*b* of the first mold 59. Moreover, a step shaping portion 61*c* corresponding to the step shaping portion 59*c* may be provided at a boundary portion between the recessed portion 61*a* and the cone shaping portion 61*b* of the second mold 61. In this case, the step portion 36 can be formed along the boundary between the dome portion 32 and the cone portion 34 of the diaphragm 30.

In the above-described manner, the dome portion 32 and the cone portion 34 of the diaphragm 30 can be formed respectively from the dome preformation portion 62 and the cone preformation portion 64 of the sheet material BL. Subsequently, an unnecessary portion of the sheet material BL around the cone portion 34 is removed, and manufacturing of the diaphragm 30 is completed.

According to the method for manufacturing the speaker diaphragm 30 of the above-described embodiment, the sheet material BL made of magnesium or magnesium alloy is protruded in the stepwise manner to form the dome preformation portion 62 and the cone preformation portion 64, and then, is shaped into the dome portion 32 and the cone portion 34. Thus, while occurrence of wrinkling and breaking of the sheet material BL can be reduced, the dome portion 32 and the cone portion 34 can be shaped such that the outer peripheral end of the cone portion 34 at least extends to the substantially same height position as that of the maximum protrusion position of the dome portion 32. Thus, while occurrence of wrinkling and breaking of the sheet material BL can be reduced, the speaker diaphragm can be formed such that the cone portion 34 is formed along the dome portion 32 and the outer peripheral edge thereof. As a result, the balance dome-type speaker diaphragm 30 being able to reduce disturbance of the sound pressure frequency properties in the high-tone range including the extremely high-tone range can be manufactured.

Note that the present invention is not limited to the above-described embodiment and the variations thereof, and various modifications and changes can be made within the scope of the contents of the claims of the present invention and an equivalent scope thereof.

What is claimed is:

1. A method for manufacturing a speaker diaphragm manufactured using a sheet material made of magnesium or magnesium alloy and including an annular cone portion along an outer peripheral edge of a dome portion, comprising:

a dome preformation process of forming a dome preformation portion in such a manner that the sheet material made of the magnesium or the magnesium alloy is, by pressing, protruded several times with a predetermined protrusion height;

a cone preformation process of forming an annular cone preformation portion in such a manner that a portion of the sheet material at an outer periphery of the dome preformation portion is, by pressing, bent several times with a predetermined bending amount in a direction inclined with respect to a protrusion direction of the dome preformation portion; and a shaping process of shaping the dome preformation portion into the dome portion by pressing, shaping the cone preformation portion into the cone portion whose outer peripheral end at least extends to a substantially identical height position to a maximum protrusion position of the dome portion, and forming, along a boundary portion between the dome portion and the cone portion, an annular step portion to which a voice coil bobbin is attached.

2. The speaker diaphragm manufacturing method according to claim 1, wherein the predetermined protrusion height is set less than a maximum protrusion height of the dome portion of the speaker diaphragm, and the predetermined bending amount is set less than a protrusion height of the outer peripheral end of the cone portion of the speaker diaphragm.

3. A method for manufacturing a speaker diaphragm, the speaker diaphragm including: a protruding dome portion formed at a center portion of the speaker diaphragm; and an annular cone portion extending from an outer peripheral edge of the dome portion in a direction inclined with respect to a protrusion direction of the dome portion, wherein the dome portion and the cone portion are, in a seamless manner, integrally formed of a sheet material made of magnesium or magnesium alloy, and an outer peripheral end of the cone portion at least extends to a substantially identical height position to a maximum protrusion position of the dome portion, and an annular step portion for attachment of a cylindrical voice coil bobbin is provided along a boundary portion between the dome portion and the cone portion, the method including:

using a sheet material made of magnesium or magnesium alloy and including the annular cone portion along an outer peripheral edge of the dome portion;

a dome preformation process of forming a dome preformation portion in such a manner that the sheet material made of the magnesium or the magnesium alloy is, by pressing, protruded several times with a predetermined protrusion height;

a cone preformation process of forming an annular cone preformation portion in such a manner that a portion of the sheet material at an outer periphery of the dome preformation portion is, by pressing, bent several times with a predetermined bending amount in a direction inclined with respect to a protrusion direction of the dome preformation portion; and a shaping process of shaping the dome preformation portion into the dome portion by pressing, shaping the cone preformation portion into the cone portion whose outer peripheral end at least extends to a substantially identical height position to a maximum protrusion position of the dome portion, and forming, along a boundary portion between the dome portion and the cone portion, an annular step portion to which a voice coil bobbin is attached.

* * * * *